US005381762A

United States Patent [19]

Evans

[11] Patent Number: 5,381,762

[45] Date of Patent: Jan. 17, 1995

[54] ENGINE COOLING SYSTEM AND RADIATOR THEREFOR

[76] Inventor: John W. Evans, 253 Rte. 41 N., Sharon, Conn. 06069

[21] Appl. No.: 201,897

[22] Filed: Feb. 25, 1994

Related U.S. Application Data

[63] Continuation-in-part of Ser. No. 946,909, Sep. 18, 1992.

[51] Int. Cl.[6] ..... F01P 3/22

[52] U.S. Cl. ..... 123/41.54; 123/41.29

[58] Field of Search ..... 123/41.54, 41.29

[56] References Cited

U.S. PATENT DOCUMENTS 5,289,803 3/1994 Matsushiro et al. ..... 123/41.54

*Primary Examiner*—Noah P. Kamen

*Attorney, Agent, or Firm*—Lyman R. Lyon

[57] ABSTRACT

A reverse flow aqueous cooling system for an internal combustion engine, comprises a radiator having a gas outlet at a high point thereof, a gas condenser having a gas inlet, a conduit including a flow restrictor disposed between the gas inlet, and gas outlet for controlling the flow of fluid from said gas outlet to said gas inlet.

2 Claims, 3 Drawing Sheets

ENGINE COOLING SYSTEM AND RADIATOR THEREFOR

BACKGROUND OF THE INVENTION

This application is a continuation-in-part of my co-pending application Ser. No. 07/946,909, filed Sept. 18, 1992, entitled "Engine Cooling System and Radiator Therefor."

The present invention relates generally to a cooling system for internal combustion engines such as used in vehicles, and more specifically to an improved radiator and pump configuration for an aqueous reverse-flow cooling system of the type disclosed in my co-pending application Ser. No. 907,392.

One characteristic of a reverse-flow cooling system is that coolant enters the engine coolant chambers at a relatively high point, passes downwardly through the coolant chambers and exits the engine block at a low point. Moreover, the coolant pump must be attached to a low point on the outlet side of the radiator. This geometry creates a potential gas trap at the top of the radiator, which, is complicated by the fact that the pressure relief and vent for the system is located at a high point of a gas separator/condenser in order to purge the engine and cylinder head coolant chambers of accumulated noncondensible gases. Trace amounts of gas and/or coolant vapor pass through the system into the radiator due to excessive volumes of coolant vapor produced during periods of high load and/or ambient conditions. If such noncondensible gases and/or coolant vapor are allowed to accumulate in a high point of the radiator without a means for venting, coolant will be displaced from the radiator by the existence of the gas pocket and an equal volume of coolant will be forced out of the cooling system vent to atmosphere. Initially the result will be a loss of cooling capacity in the radiator causing a higher coolant operating temperature. As the displacement of coolant increases due to additional gases being trapped within the radiator, system failure may occur.

There also exists a need to establish a means to maintain the engine cooling chamber filled with coolant after the engine has been shut off and a significant portion of coolant has been lost from the system. If such coolant loss is experienced while the engine is running, and there is no coolant level control means for the coolant chambers, when the coolant level is lowered in the radiator and the engine is running, the coolant pump will continue to draw from the radiator, keeping the engine coolant chambers filled with coolant, and lowering the coolant level in the radiator but not in the coolant chambers. However, when the engine is turned-off, and the pump stops flowing coolant, the coolant level in the coolant chambers of the engine is immediately lowered and raised in the radiator as the effect of gravity reacts to equalize the two levels. Severe damage may occur from such losses since the head coolant chamber is at the highest heat level of the entire engine. Even at moderate loads and heat levels severe damage such as metal fatigue, cracking, and distortion will occur from such losses of coolant.

An additional problem that exists when employing an aqueous reverse flow engine cooling system to many of the down-sized engine compartments of present day vehicles is that there is insufficient space available in order to fit both the gas separator/condenser and coolant expansion reservoir as depicted in my U.S. Pat. No. 5,255,636. This problem becomes especially difficult when attempting to use the gas separator/condenser as an elevated "fill" tank in vehicles with low silhouette or sharply angled hood lines.

SUMMARY OF THE INVENTION

One of the aforesaid problems is solved by an engine coolant system that is adapted to cause the engine coolant chambers to remain full after the engine is shut off subsequent to substantial coolant loss. The coolant level control system comprises a high inlet loop in the inlet conduit of the coolant pump which incorporates a one-way flow directional valve. Alternatively, a circuit may be used which relocates the coolant pump to the highest point of a high inlet loop. An optional feature of both circuits is a low level warning system comprising a sensor and an indicator. When a substantial volume of coolant is lost during running of the engine, the coolant pump will, as long as the engine is running, continue to draw coolant from the radiator lowering the coolant level in the radiator as it keeps the engine cooling chambers full. When the engine is shut off, or dropped to a low idle speed, a high loop in the coolant pump's inlet conduit which rises to a level equal to or slightly above the cylinder head coolant chamber functions jointly with the elevation of the radiator inlet port to isolate the radiator from receiving coolant from either its inlet conduit or backwards through its outlet conduit no matter how low the coolant level is in the radiator. The high loop and the height of the radiator inlet relative to the top of the coolant chamber negate the effect of gravity from causing the level in the engine cooling chambers to drop in attempting to equalize the lower coolant level in the radiator even after a substantial coolant loss.

If the inside diameter of the outlet conduits from the radiator are not of significant size the radiator may have a tendency to draw coolant backwards through the conduits by a syphoning action pulling coolant up and over the high loop. When such a syphoning condition exists, then a one-way flow control valve is placed in the radiator outlet conduit in order to stop the syphoning action.

Another of the aforesaid problems being the occurrence of gas entrapment within the structure of a radiator operating in the circuitry of an aqueous reverse flow cooling system is solved by the adaption of either a full time, or a cyclical degassing circuit connecting to the high point of the radiator. In one instance the circuit passes to the separator/condenser, and in another to the coolant recovery tank.

Lastly, the final of the aforesaid problems being the placement of the gas separator/condenser within the limitations of small vehicles engine compartments is solved by the combined structure of the radiator outlet tank to serve the dual function of operating as a coolant manifold, for the radiator core, and as the gas separator/condenser.

DETAILED DESCRIPTION OF THE PREFERRED EMBODIMENTS OF THE INVENTION

Figure 1:
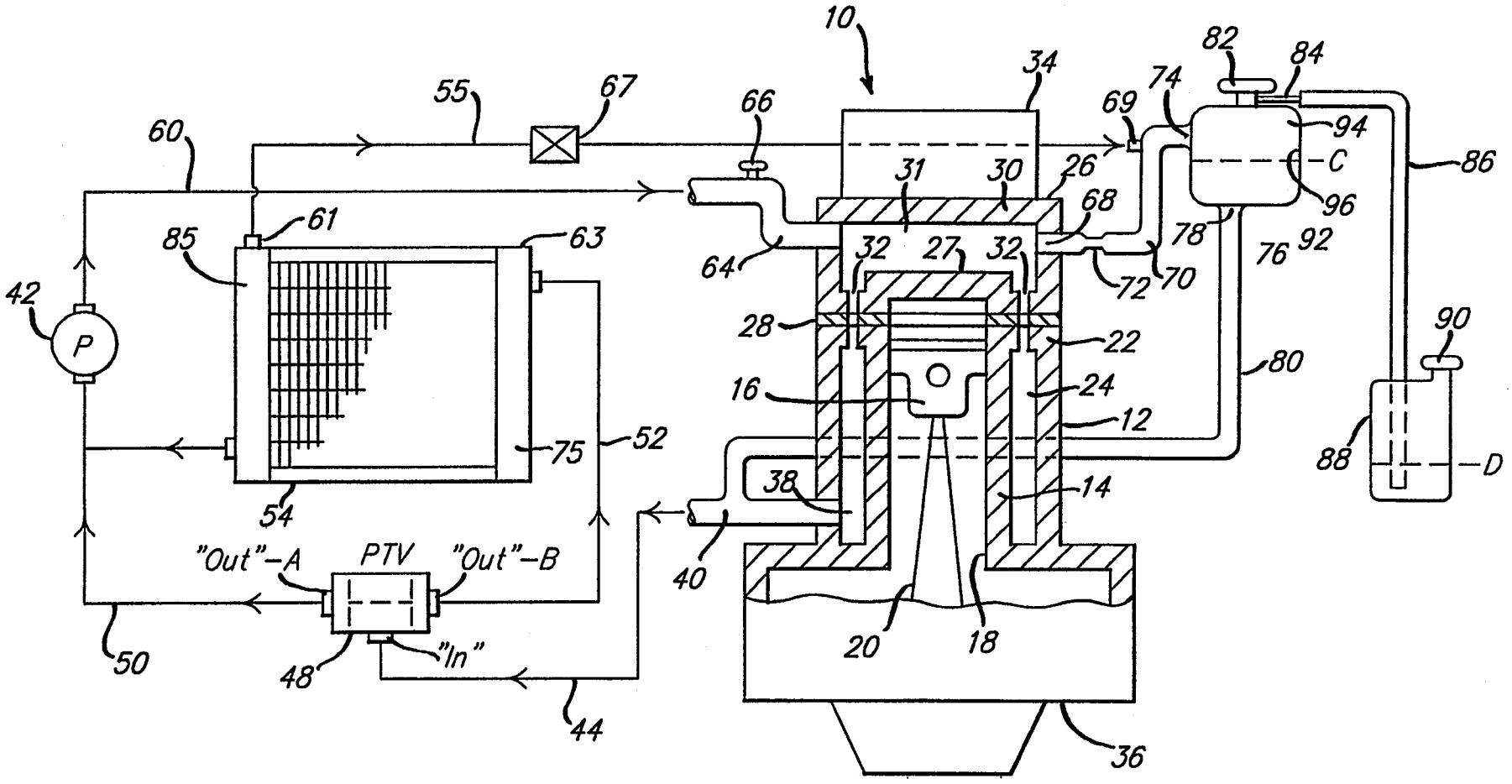
FIG. 1 is a schematic depiction of an aqueous reverse-flow cooling system which will allow for proper venting of the trapped gases within the radiator.

As seen in FIG. 1, an internal combustion engine 10 embodying the reverse-flow cooling system of the present invention, comprises an engine block 12 having a cylinder wall 14 formed therein. A piston 16 reciprocates within a complementary cylinder bore 18. The piston 16 is coupled to a crank shaft (not shown) by a connecting rod 20.

A block coolant jacket 22 surrounds the cylinder wall 14, and is spaced therefrom so as to define a block coolant chamber 24 therebetween. The block coolant chamber 24 accommodates coolant flow therethrough to cool the metal surfaces of the engine 10.

A combustion chamber 25 is defined by a cylinder head 26 having a combustion chamber dome 27 therein defining and disposed above the combustion chamber 25. A head gasket 28 is seated between the cylinder head 26 and the engine block 12. The cylinder head 26 includes an upper jacket portion 30 which, in conjunction with the combustion chamber dome 27, defines a head coolant chamber 31. The head gasket 28 seals the combustion chamber 25 from the coolant chamber 31 and, likewise, seals the coolant chamber 31 from the exterior of the engine 10. A plurality of coolant ports 32 extend through the base of the cylinder head 26, through the head gasket 28, and through the top of the block coolant jacket 22. A valve cover 34 is mounted on top of the cylinder head 26. The engine 20 further comprises an oil pan 36 mounted to the bottom of the block 12 to hold the engine's oil.

In accordance with reverse flow technology, engine coolant flows from the head coolant chamber 31, through the coolant ports 32, and into the block coolant chamber 24. Coolant then flows from the block coolant chamber 24 through coolant lines 40 and 44 to a proportional thermostatic valve 48. An outlet "A" of the valve 48 is coupled to a radiator bypass line 50 leading to the inlet side of a pump 42. The size of the pump 42 is determined to achieve the coolant flow rates required under maximum operating loads.

An outlet "B" of the valve 48 is coupled to a radiator line 52. The valve 48 is set to detect a threshold temperature of the coolant flowing through the coolant line 44. If the temperature of the coolant is below the threshold, the valve 48 directs a proportional amount of coolant through the bypass line 50. If, on the other hand, the coolant temperature is above the threshold, the valve 48 directs the coolant into the radiator line 52. The other end of the radiator line 52 is coupled to a radiator 54.

Both the output line 56 of the radiator 54 and the bypass line 50 are coupled to the inlet side of the pump 42. The outlet side of the pump 42 is connected to a coolant return line 60. The coolant return line 60 is in turn coupled to an input port 64 at any level in chamber 31 of the cylinder head 26. Thus, depending upon the temperature of the coolant flowing through the coolant line 44, the coolant flows either through the bypass line 50 or the radiator 54, which are both in turn coupled, through the pump 42, to the return line 60.

During engine warm-up, when the coolant temperature is relatively low, coolant is directed by the valve 48 through the bypass line 50. However, once the engine is warmed up, at least some of the coolant is directed through the radiator 54. The lower temperature coolant flowing through the pump outlet line 60 flows through the input port 64 and into the engine 10.

In the aforesaid system, gases may exist as either trapped air pockets remaining subsequent to the initial fill, or due vacuum leaks which occur during running of the engine and which draw in air at connections of hoses. Additionally, combustion gases may enter the system through the coolant chambers 24 and 31 in the event of defective sealing at the head gasket 28. Eventually such gases pass through conduit 52 and enter a radiator inlet tank 63 where they rise to the upper most regions of the radiator 54. Such gases normally accumulate at the highest point of the radiator 54 and are removed by way of the vent port 61 which is preferably also located at the highest point of the radiator 54, the vent port 61 may be located on either the tank 85 or at a high point 63, of a tank 75 of the horizontal cross flow radiator 54. However, the preferred location is on the outlet tank 85. In the case of a vertical flow radiator, which would have top and bottom tanks (not shown), the vent port 61 would always be located at a high point the top tank. For either connection point 61 or 63 it is preferred to use a restriction means shown as flow restrictor 67 to limit the passage of coolant through conduit 55. The flow restrictor 67 may be of a small inside diameter conduit, or achieved by balancing of the connection ports 61 and 69 so as to create a large pressure differential.

In operation when the vent port 61 is located at the high point on the radiator outlet tank 85, any noncondensible gases or small amounts of coolant vapor which accumulate at the top of radiator 54 will pass out through vent port 61 along with some liquid coolant through conduit 55 and into the gas separator/condenser 76, due to connection of conduit 55 to the inlet port 69 on the vent line 70. The gases which enter the separator/condenser 76 will immediately separate from the coolant, with which the gases entered, and the gases will rise to the top of the separator/condenser 76. The noncondensible gases will subsequently vent to atmosphere by way of pressure relief cap 82. Any slight amount of coolant vapor will condense in the manner described in my co-pending application Ser. No. 907,392. Because, during certain periods of operations of pump 42, high flow rates and/or certain operating positions of thermostat 48, there exists a greatly superior vacuum (negative pressure) in the separator/condenser 76 circuitry than at the vent port 61, excessive and undesirable coolant flow will occur through conduit 55. Such excessive flow through the radiator vent circuit will cause coolant to by-pass the engine 10 and coolant chambers 24 and 31 which will cause the engine to run hotter by a degree of magnitude in proportion to the volume of coolant by-passed. The use of a flow restrictor 67, as described above in the vent circuitry between and including outlet vent port 61 and inlet vent port 69 establishes that only a minor fraction of coolant passes through conduit 55 into the separator/condenser 76 and by-passes the coolant chambers 24 and 31.

When the vent port is located on the radiator inlet tank 75 at high-point 63 a similar condition occurs as described above except that the temperature rise caused by by-passing of the coolant is compounded by two additional factors, namely, (1) the coolant being by-passed is from the inlet ("hot" ) tank and never passes through the radiator 54, so it is therefore hotter coolant and will cause a rise in the temperature level of the separator/condenser 76, and (2) the inlet tank 75 is at a higher pressure than the outlet ("cold" ) tank 85 so there is more pressure and more flow potential through the conduit 55, by-passing the coolant chambers 24 and 31, and therefore a need for a greater degree of flow restriction of the radiator venting circuitry between outlet port 63 and inlet port 69. It is therefore preferable to locate the vent port outlet 61 for the radiator vent circuit at the high-point of the cold tank 85 radiator 54.

Figure 2:
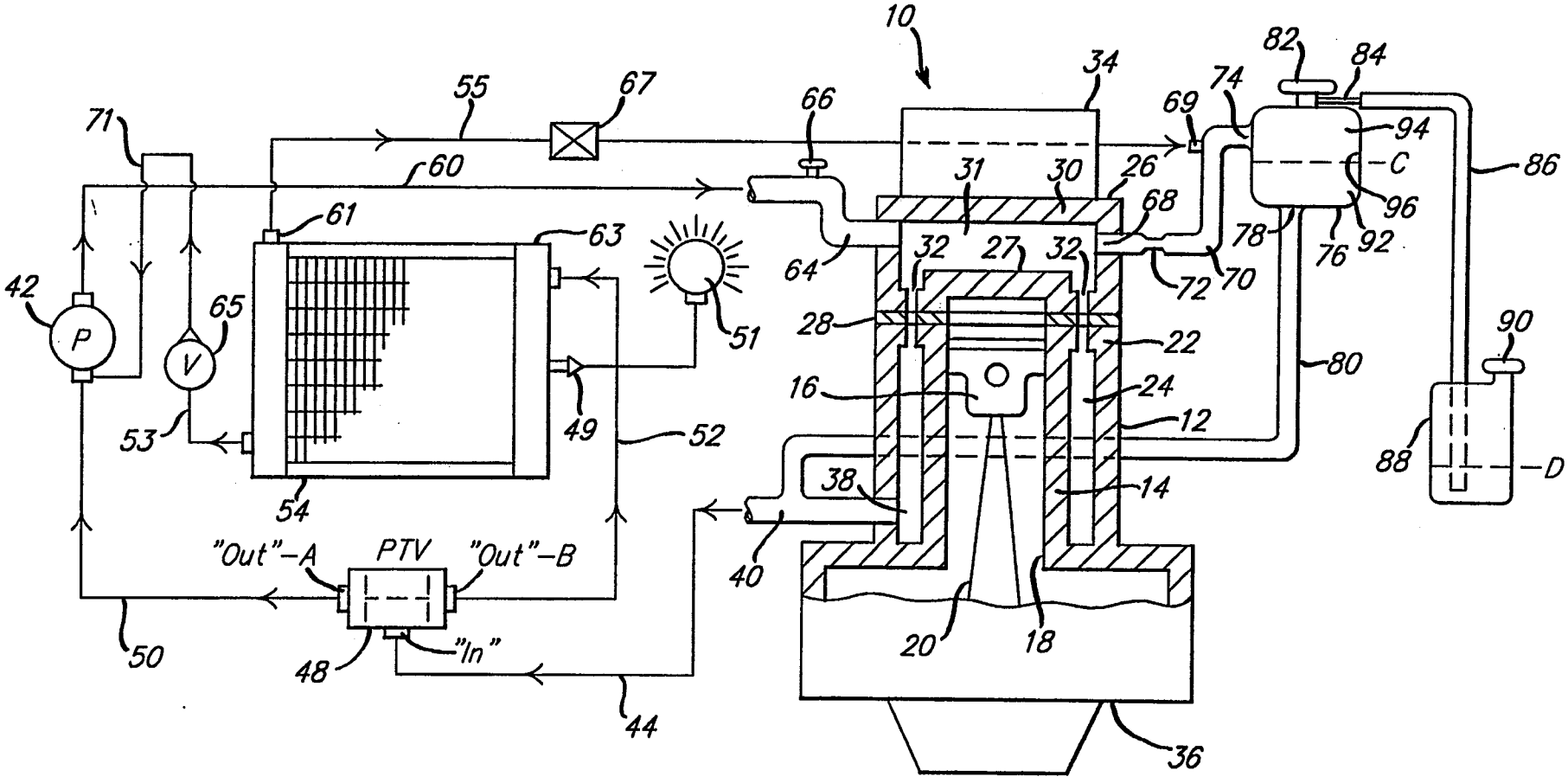
FIG. 2 is a modification of the system of FIG. 1 which is adapted to cause the engine coolant chambers to remain full after the engine is shut off subsequent to a substantial coolant loss.

FIG. 2 depicts an aqueous reverse-flow engine cooling system which is further adapted to cause the engine coolant chambers to remain full after the engine is shut off subsequent to a substantial coolant loss. The coolant level control system comprises a high inlet loop 71 in the inlet conduit 53 of pump 42 which incorporates a one-way flow directional valve 65. Alternatively a circuit which relocates the coolant pump 42 to the highest point of the high inlet loop 71 (not shown). An optional feature of both circuits is a low level warning system of a sensor 49 and indicator 51. The operation of these new features is as follows: when a substantial volume of coolant is lost during the running of the engine 10, as depicted in FIG. 2, the pump 42 will, as long as the engine is running, continue to draw coolant from the radiator 54 by means of conduits 53 and 71, lowering the coolant level in radiator 54 as it keeps the engine cooling chambers 24 and 31 full by coolant entering and filling the chambers 24 and 31 through conduit 64. When the engine 10 is shut-off, or dropped to a low idle speed, and if the radiator inlet 63 is equal to chamber 31 then high loop 71 of the coolant pump's inlet conduits 53 and 71, which rises to a level equal to or slightly above the cylinder head coolant chamber 31, forms jointly with the elevation of the radiator inlet port at 63 to isolate the radiator 54 from receiving coolant from either inlet conduit 52 or backwards through outlet conduit 53 no matter how low the coolant level is in radiator 54. The high loop 71 and the similar or superior height of the radiator inlet at 63 to the top of the coolant chamber 31 negate the effect of gravity from causing the level in cooling chambers 24 and 31 to drop in attempting to equalize with the lower coolant level in radiator 54 after a substantial coolant loss. If the inside diameter of the conduits 53 and 71 is not of significant size then the radiator 54 may have a tendency to draw coolant backwards through conduits 53 and 71 by syphoning action pulling coolant up and over the high loop 71 through the pump 42 by communication with cooling chamber 24 through the thermostat 48. When such a syphoning condition exists then a one way flow control (check) valve 65 is placed in conduit 53 in order to stop the syphoning action. When such a check valve 65 is employed the conduit 53 may be passed directly from the outlet side of the check valve 65 to the inlet side of the pump 42 eliminating, in some instances, the need for the high loop 71.

Alternatively, to the check valve 65 described above, if the construction of the system predicts a syphoning condition may exist or if merely for the functional ease of placement, the pump 42 may be moved from a low mounted position to a relocated mounting point at the top of the inlet high loop 71. When mounted in such location, the pump 43 inlet port must be disposed at equal height or above the coolant chamber 31 and the mid-point of the pump 43 impeller cavity; then the internal chamber volume of the impeller cavity and passages of the pump 42 will create an in-line expansion chamber which will cause a vacuum break of any syphoning action, no matter what conduit sizes are used. In this case, the check valve 65 can be eliminated.

However, when the pump 42 is located at an elevated position, the efficiency of the pump 42 and any flow restrictions in front of the pump inlet must be addressed in that the higher location of the pump places a higher resistance on its ability to draw coolant which results in reduced pump efficiency. Pump impeller blade configuration must be addressed as well as the pressure drop across the down stream components such as the thermostat 48, as well as the flow characteristics of the radiator 54. The inlets and outlets of radiator 54 as applied to the total cross-sectional flow area, as further limited by the overall length of the tubes, must be constructed as a unified component to keep the flow resistance and pressure drop, across the radiator 54, to a minimum level at which the coolant flow rate of the elevated pump 42 will not be adversely effected. Factors, in the design and construction of the radiator 54, which effect the flow resistance of the radiator 54 are described in further detail below.

It should be further noted that even with the pump 42 located in the lower position, as depicted in FIG. 1 and FIG. 2, and with the employment of the one way flow directional valve 65 allowing for the direct connection of conduit 53 to pump 42 (thereby eliminating the inlet high-loop 71), the flow resistance (differential pressure drop) across the radiator 54 must still be controlled to an acceptable minimum level. The coolant flow rate must be properly established in order to effectively control the amount of coolant vapor produced, and its subsequent removal, at the coolant to metal interface within the engine coolant chambers 24 and 31 as detailed in my two co-pending applications, Ser. No. 907,392 and 947,144.

It is well known that centrifugal pumps, as typically used on internal combustion engine cooling systems, have a far greater ability to "push" coolant (out, the outlet), than they have to draw coolant (in, the inlet). In order to accomplish the coolant flow rates discussed previously, by the lowering of the radiator 54 tubing frictional flow resistance (core 73 pressure drop) the following structural features, of the tubing which comprises core 73, will result in the desired reduction in flow resistance when used either individually or jointly;

(1) An increase in the core 73 tube "stack" (total number of tubes available to flow coolant from the inlet tank to the outlet tank) while the tube length usually remains the same or is shortened, this is normally accomplished in a cross-flow (horizontal flow) side tank radiator 54, by increasing the overall core 73 (number of tubes up and down) or, as in the case of a down-flow (vertical flow), top and bottom tank radiator 54 by increasing the overall core 73 width (number of tubes across the horizontal).

(2) An increase in the number of tubes per row, while maintaining the same tube I.D., across the core 73 faces; (the "Depth"), between the cold air side and the heated air side of the core 73, which will normally cause an increase in the overall core 73 "Depth."

(3) A substantial increase in the core 73 individual tube I.D. while keeping the number of tubes per row, across the core 73 faces; (the "Depth") the same, which will normally cause an increase in the overall core 73 "Depth."

The coolant low level indicator circuitry, shown in FIG. 2, as a low coolant level sensor 49 placed at an optimum level in the wall of either tank of the radiator 54 and an indicator alarm 51, which can be either visual or audible, is employed to work with the one way valve 65 and/or the pump inlet high loop 71 as follows; if a substantial coolant loss is suffered, normally from a leak or overheat condition, then the pump 42 (or alternately a pump mounted at point 43) and/or the high loop 71, or in some instances one-way valve 65 will prevent the coolant, which is at a high level in coolant chambers 24 and 31, from rushing into radiator 54, as previously described, when the action of the pump 42 or 43 stops or reduces (idle speed) flowing coolant from the radiator 54 into the coolant chambers 24 and 31. The low coolant sensor 49 is ideally placed at a level where the low operating coolant level of the radiator core 73 will cause the engine 10 to run excessively hot but within acceptable limits. The engine 10 operator will be alerted to the low level coolant condition by the higher operating temperature (conventional over temp alert circuit) and/or the low level indicator 51. However, as opposed to currently employed production systems, the addition of the high loop 71, pump relocation 43, and/or the one-way valve 65 will prevent the coolant from equalizing the coolant levels of the core 73 and the coolant chambers 24 and 31 after the engine operator reacts to the low-level and/or over-temp alarm and the engine is reduced to an idle speed, or shut down completely. During such an occurrence, after a substantial coolant loss and subsequent to engine shut-down, the coolant level will remain full in the engine coolant chambers 24 and 31, no matter how low the coolant level is in the radiator core 73, and the engine 10 will slowly drop in temperature without damage from coolant loss in the coolant chamber 31 of the cylinder head 26 resulting in metal distortion and/or cracking. The coolant level in the radiator core 73 will remain at the reduced level, and lower subsequent to cooling (contraction) and the coolant low level sensor 49 will remain activated alerting the driver, continually during and after cool down, of the low level condition.

Figure 3:
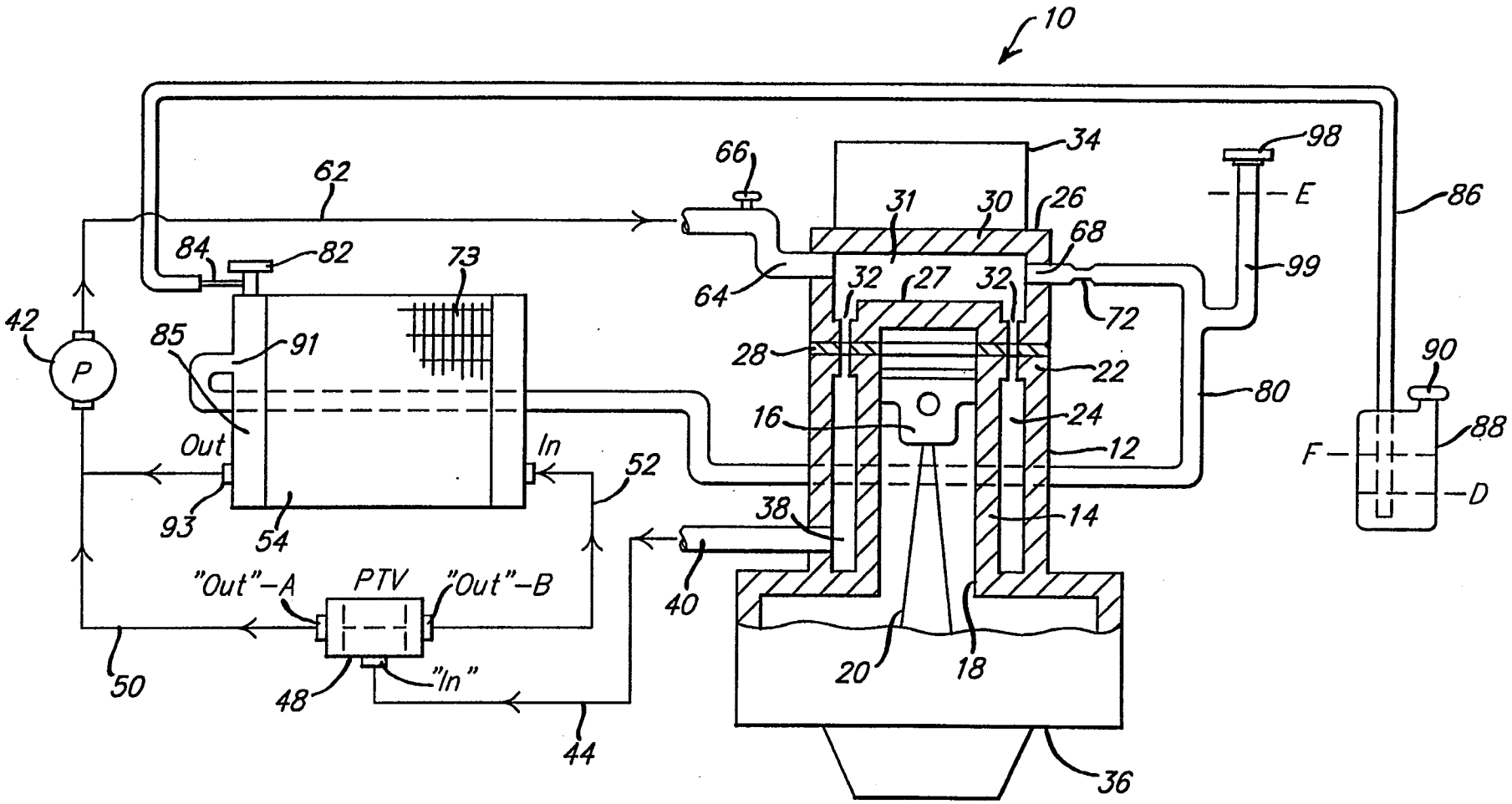
FIG. 3 is a modification of the systems of FIGS. 1–2 adapted to incorporate the gas separator/condenser into the structure of the radiator.

FIG. 3 depicts another aqueous reverse flow engine cooling system which is further adapted to combine the functions of coolant manifolding for the radiator core 73 and system gas separation and condensing (separator/condenser tank) within the structure of the radiator 54 outlet tank 85.

In operation the remote mounted gas separator/condenser tank, as described in my U.S. Pat. No. 5,255,636 is not used and the gas vent line 80, restricted in flow (shown as line restriction 72) is connected alternately at the gas port 91 to the radiator 54 outlet tank 85. It is located preferably in the uppermost half of the tank 85 at a safe distance from the outlet 93. Adequate distance must be maintained between the gas port 91 and the tank coolant outlet 93 so that gases entering into the tank 85 will rise to the top and not be drawn out of the tank 85 through outlet 93 with coolant passing out of the radiator 54 to pump 42.

As described in my prior patent, any gases residing in the coolant chamber 31 will be forced by positive pressure of the reverse coolant flow entering chamber 31, by way of conduit 64, to pass out of the chamber 31 through the outlet port 68, into the gas separator/condenser circuitry formed by the combined structure of the vapor line 80, restrictor 72, and the radiator outlet tank 85. The outlet tank 85 is on the low pressure (pump draw) side of the radiator 54 and therefore a differential pressure will be established by the higher pressure within chamber 31 and the lower pressure of tank 85 which will establish flow through line 80. A restriction placed upon line 80, shown as an in-line restrictor 72, allows that a major portion of all residual gases in chamber 31 will pass through line 80 while only a minor volume of coolant will be allowed to pass at any given time. The restriction may be as shown or alternately may be established by using a small inside diameter line size, or carefully locating the attachment ports 68 and 91 to establish a relatively low pressure differential.

Coolant vapor which enters the outlet tank 85 will rise upwards and when acted upon by the coolant within tank 85, which has been reduced in temperature by passing through the core 73, the coolant vapors will condense and be added to the liquid coolant within the tank 85 and returned to the cooling circuit. Noncondensible gases (combustion leaks and air) will also rise to the top of tank 85. However, such gases will also rise to the top of tank 85. However, such gases will remain and accumulate as they cannot pass down and out port 93 and ultimately will be vented through pressure cap 82, at such time there is a rise in system pressure beyond the value of cap 82 or at subsequent "start-up" after the system is "cooled-down." This will be accomplished by the typical action of a conventional bi-directional pressure cap 82. During "cool-down," contraction of the engine coolant draws reserve coolant from the coolant reservoir 88 up through line 86 and into tank 85 through the vent connection 84 and bi-directional cap 82. No vacuum will be created in reservoir 88 due to cap 90 being open to atmosphere. Any accumulated noncondensible gases will remain at pressure cap 82 after total "cool-down" and, at subsequent start-up, will be forced by the expanding coolant out of the pressure cap 82 through line 86 into reservoir 88 and released to atmosphere.

If when installed in a confined space, such as the front of a vehicle, the radiator 54 is required to be mounted lower than the highest liquid level "A" of engine 10, then a positively closed (nonvented) fill cap 98 may be placed at a location higher than the liquid level "A" and therefrom connected to the cooling system by a conduit 99. Proper coolant fill of the cooling system is monitored by removing cap 98, after complete cool-down, and verifying of the coolant fill is visually checked by observing the cold level "D" or hot level "F" in the nonpressurized reservoir 88.

If desired, the entire cooling system including the expansion reservoir 88 can be pressurized and closed to atmosphere. This is accomplished by replacing the pressure cap 82 with a nonpressurized cap (open vented) which places vent port 84 in open communication with the outlet tank 85 at all times. A pressure cap, typically set at 14 to 17 psig would then be installed in place of the open vented cap 90 on reservoir 88. The reservoir 88, line 86 and all connections would require redesign to be sufficiently strong to withstand the pressure under which they would then operate.

While the preferred embodiment of the invention has been disclosed, it should be appreciated that the invention is susceptible of modification without departing from the scope of the following claims.

I claim:

1. In a reverse flow aqueous cooling system for an internal combustion engine comprising a coolant pump, cylinder head coolant chamber and a cylinder block coolant chamber, the improvement comprising;

a radiator having a coolant inlet tank and a coolant outlet tank.

a conduit connecting a low point in said cylinder block coolant chamber to said coolant inlet tank;

a conduit connecting an outlet side of said pump to said cylinder head coolant chamber;

a flow restricted gas vent conduit connecting a high point in said cylinder head coolant chamber to a gas inlet in said coolant outlet tank; and a conduit connecting a coolant outlet in said coolant outlet tank to the inlet side of said pump and spaced downwardly from the gas inlet in said coolant outlet tank to preclude the flow of gases from the high point within said cylinder head coolant chamber to said pump.

2. The cooling system of claim 1 wherein said gas inlet is at a midpoint vertically of said coolant outlet tank and said coolant outlet is at the bottom thereof.

* * * * *